United States Patent [19]

Rosengarten

[11] Patent Number: 5,054,816

[45] Date of Patent: Oct. 8, 1991

[54] COMBINED BOOK CLOSURE AND PAGE INDEXING DEVICE

[76] Inventor: Gerald J. Rosengarten, 30 W. 13th St., New York, N.Y. 10011

[21] Appl. No.: 592,136

[22] Filed: Oct. 3, 1990

[51] Int. Cl.[5] ..... B42D 9/00

[52] U.S. Cl. ..... 281/42; 281/45

[58] Field of Search ..... 281/42, 45, 46, 47, 281/48

[56] References Cited

U.S. PATENT DOCUMENTS

| | | | |
|---|---|---|---|
| 1,346,856 | 7/1920 | Sprague | 116/239 |
| 1,363,120 | 12/1920 | Johnson | 281/42 |
| 2,224,703 | 12/1940 | Spencer | 281/42 |
| 3,898,951 | 8/1975 | Clare | 116/119 |
| 4,041,892 | 8/1977 | Nichols | 116/119 |
| 4,162,800 | 7/1979 | Gonot, Jr. et al. | 281/42 |
| 4,505,219 | 3/1985 | Mangano | 116/234 |
| 4,572,546 | 2/1986 | Morrison | 281/45 X |

FOREIGN PATENT DOCUMENTS

| | | | |
|---|---|---|---|
| 507913 | 9/1930 | Fed. Rep. of Germany | 281/42 |

*Primary Examiner*—Timothy V. Eley
*Assistant Examiner*—William Fridie, Jr.
*Attorney, Agent, or Firm*—Natter & Natter

[57] ABSTRACT

A combined book closure and indexing device includes a continuous loop adapted for encircling a cover of a book and a plurality of the pages therein to provide a demarcation between the read and unread portions of the book. A closure loop connected to the indexing loop is utilized to circumscribe the book and protect the pages by securing the book in a closed position.

20 Claims, 2 Drawing Sheets

FIG. 1
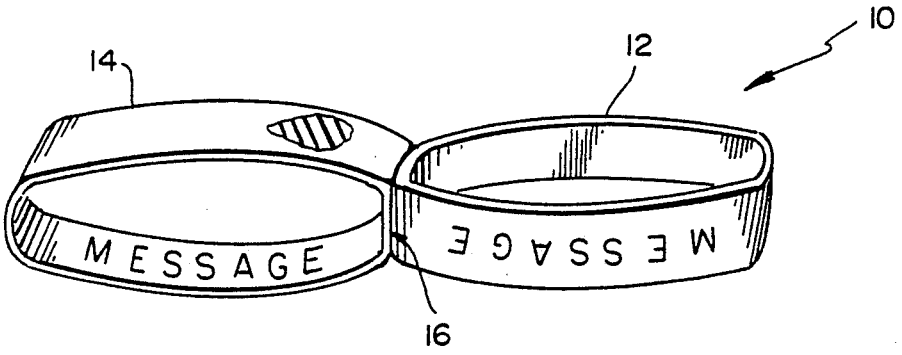
FIG. 4
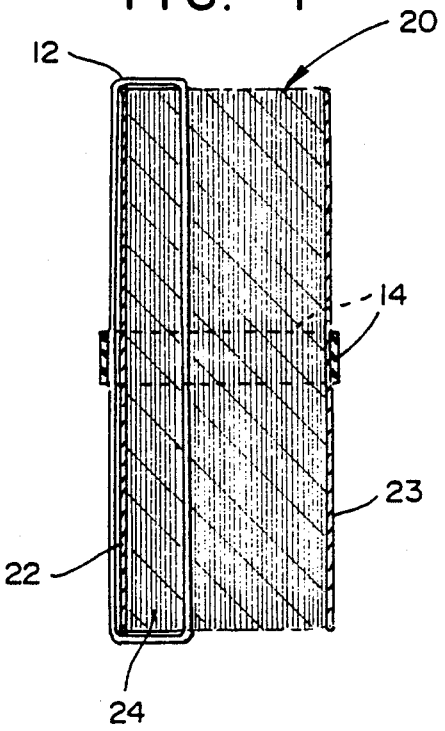
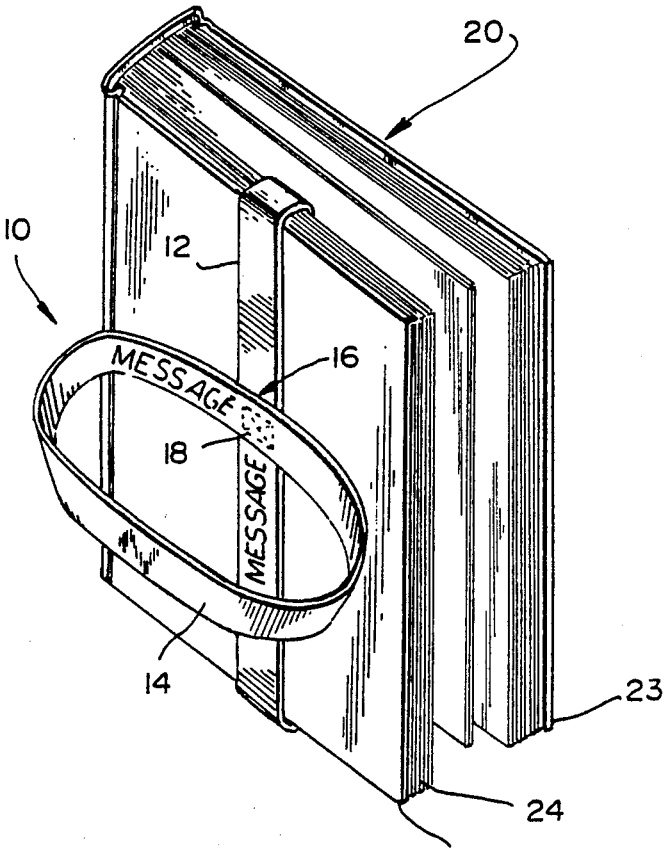
FIG. 2

COMBINED BOOK CLOSURE AND PAGE INDEXING DEVICE

FIELD OF THE INVENTION

This invention relates generally to book-leaf holders and especially to a device for the demarcation of selected pages of a book as a measure of reading progress incorporating a closure member for precluding the book from inadvertently being opened.

In particular, this invention concerns a combined book closure and page indexing device having resilient loop members.

2. Background Art

Conventional page indicators for books include planar strips which are interposed between the book-leaves typically, after each reading. These bookmarks are useful when the book is rested or stored on a bookshelf, library table or similar stationary support surface.

A problem with the aforementioned bookmarks is that they do not readily remain within the book and are frequently lost or otherwise misplaced. Furthermore, these bookmarks tend to become dislodged especially when the book is moved from place to place. For example, students and others who enjoy reading frequently carry reading materials by hand, in a briefcase, pocketbook, backpack or similar conveyance so that the book will be readily available for reading e.g. while in a bus, at the beach or at other locations. In these circumstances, it is advantageous to have a page indexing device which is firmly secured to the book. It is also important to provide for a book closure so that the pages of the book do not become soiled, damaged or dog-eared.

Previous attempts to provide improved book-markers or related devices are typically shown in U.S. Pat. Nos. 4,041,892; 4,162,800; 4,505,219; and 3,898,951.

A shortcoming of these devices is that they are primarily directed to marking preselected pages of a book and are not concerned with the protection of the pages in the book.

Furthermore, these patented devices do not provide the versatility and convenience of the instant invention. Additionally, they are not designed to function as an advertising display.

SUMMARY OF THE INVENTION

Briefly, the nature of this invention involves a book reader's aid which provides a page indicator for denoting previously read pages from unread pages and a book closure member for securing the book.

The combined book closure and indexing device is comprised of two interconnected continuous loops. One of the loops being adapted for placement around either a front or back cover of the book for releaseably holding a number of selected pages of the book. The other of said loops is adapted for encircling both covers for securing the book in a closed position.

The respective loops are fabricated of a stretchable material incorporating elastomeric fibers. An advertising message or similar indicia can be imprinted, woven or otherwise placed on the surface of the material.

A feature of this invention is that a page indexing loop is resiliently extendable for us with books having different dimensions.

Still another aspect of this invention is that the page indexing loop is securely affixed to the book and the book closure is therefore readily available to the user.

Furthermore, the device is particularly adapted for use as a promotional item or advertising novelty.

In view of the foregoing, it should be apparent that the present invention overcomes many of the deficiencies of the prior art and provides an improved book closure and page indexing device.

Having thus summarized the invention it will be seen that it is an object thereof to provide a combined book closure and page indexing device of the general character described herein which is not subject to the aforementioned deficiencies.

Another object of this invention is to provide a page indexing device that is attachable to a book and is adaptable for use with a range of different sized books.

Still another object of this invention is to provide a book closure device for resiliently urging the book covers toward each other to prevent free page movement.

A still further object of this invention is to provide a page indexing device for separating the previously read pages in the book from unread pages in the book.

Yet another object of this invention is to provide a book closure and page indexing device for conveying an advertising message.

Other objects of this invention will in part be apparent and in part will be pointed out hereinafter.

With these ends in view, the invention finds embodiment in certain combinations of elements and arrangement of parts by which the aforementioned objects and certain other objects are hereinafter attained, all as more fully described with reference to the accompanying drawings and the scope of which is more particularly pointed out and indicated in the appended claims.

BRIEF DESCRIPTION OF THE DRAWINGS

In the accompanying drawings in which are shown exemplary embodiments of the invention:

FIG. 1 is a perspective view illustrating the combined book closure and page indexing device of this invention;

FIG. 2 is a perspective view of the device showing a page indexing loop applied to a book for providing page demarcation and a book closure loop attached thereto;

FIG. 4 is a sectional view taken substantially along lines 4—4 of FIG. 3 and further illustrating the operative arrangement of the page indexing loop and the book closure loop;

DETAILED DESCRIPTION OF THE INVENTION

Figure 3:
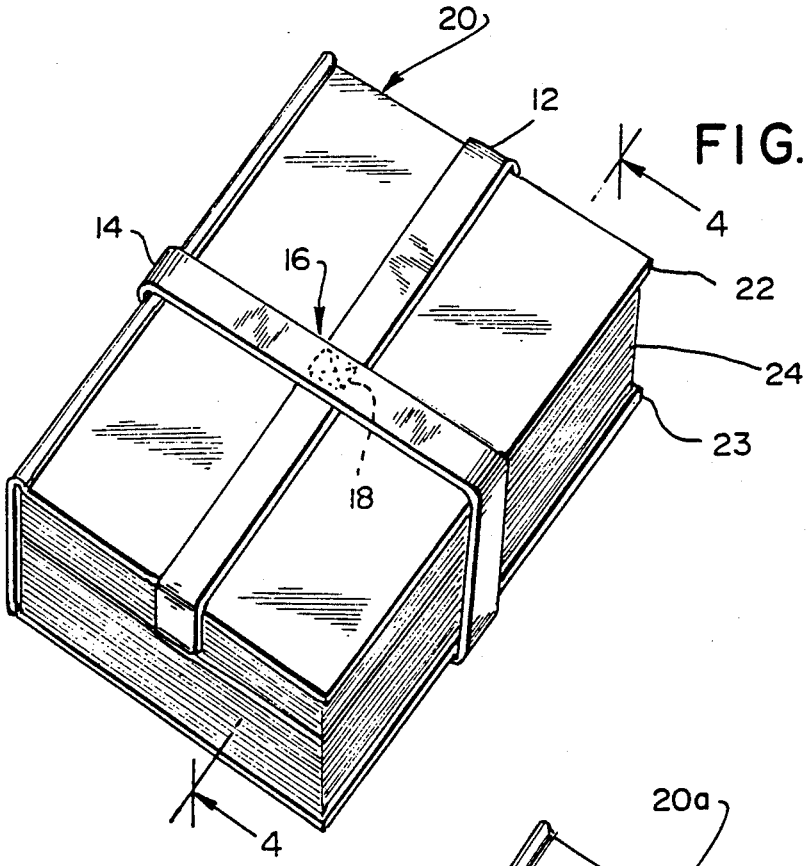
FIG. 3 is a perspective view of the book in FIG. 2 showing the closure loop circumscribing the book for retaining same in a closed position.

Referring now in detail to the drawings, the reference numeral 10 denotes generally a combined book closure and page indexing device of this invention.

The device 10 is intended for application with a range of different size books. With regard to the exemplary embodiment shown in FIG. 1, the device 10 includes a page indexing loop 12 and a book closure loop 14. Each of the loops 12, 14 is comprised of a continuous band of elastomeric material, preferably woven or braided fabric containing elastic fibers. By way of example, the loops 12, 14 are approximately 12–14 inches in length and about 1 inch in width. It should be understood however, that each of the loops 12, 14 may be of a different length and/or width e.g. the page indexing loop 12 can be as narrow as ⅛ inch. Furthermore, the loops 12, 14 can be formed as a continuous band or can be comprised of one or more band segments joined at their respective ends to form a continuous member.

As further noted in FIG. 1, the loop 12 lies substantially in a first plane and the loop 14 lies in a second plane displaced 90 degrees from the first plane. The purpose of this orthogonal relationship between the loops 12, 14 is to assure that the respective loops 12, 14 will lie parallel to and on the surfaces of the book.

Furthermore, the fabric construction of the loops 12, 14 provides a medium for bearing indicia such as an advertising slogan, a company name, or other promotional material. Thus, the device 10 also provides an advertising novelty for conveying messages.

The loops 12, 14 are interconnected at a point of intersection of the planes providing a common locus 16. The connection of the respective loops 12, 14 is accomplished by stitching 18 although alternative methods such as complementary velcro strips, buttons, ribbons, snaps or similar fasteners may be employed for accomplishing this result.

FIG. 2 illustrates the page indicating function of the device 10 and shows a book 20 having a front cover 22 and a back cover 23 and a plurality of sheets or pages 24 carried therebetween. The page indexing loop 12 encircles the front cover 22 of the book 20 and the pages 24. It should thus be apparent that the indexing loop 12 is adaptable for separating the read pages from the unread portion of the book 20. The elasticity of the loop 12 provides for yieldable engagement over a range of pages 24. It should also be noted that the book closure loop 14 is secured to the page indexing loop 12 and is therefore readily available when one has completed reading a portion of the book 20. The orthogonal arrangement of the respective loops 12, 14 as previously mentioned, is suitable for providing contiguous encirclement of the book 20 by the closure loop 14. As will be observed in FIG. 3, not only is the indexing loop 12 secured in place, but the pages 24 of the book 20 are yieldably held between the respective book covers 22, 23 and are thus protected from damage. It should thus be apparent that the book 20 can be deposited within a carry-case or other travel bag without displacement of the page indexing loop 12 or damage to the pages 24.

Figure 5:
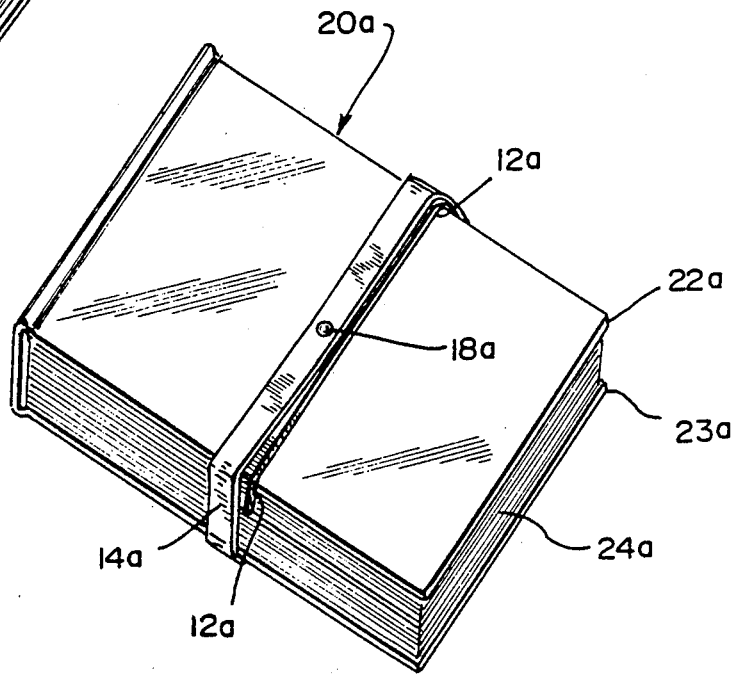
FIG. 5 is a perspective view of another size book illustrating an alternate embodiment of the invention wherein the indexing loop and the book closure loop are operatively positionable along a coincident axis.
Figure 6:
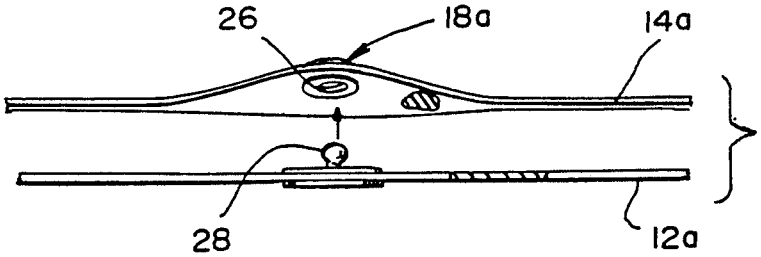
FIG. 6 is a sectional view to an enlarged scale showing a selectively detachable pivotal interconnection between the respective loops shown in FIG. 5.

An alternate embodiment of the invention is illustrated in FIGS. 5 and 6 wherein a snap fastener **18*a* replaces the previous stitched loop connection at the common locus 16. The snap fastener 18*a* includes a socket 26 and a ball member 28 adapted for snap-fit engagement within the socket 26. Furthermore, when engaged, the snap fastener 18*a* provides for rotational displacement to thus permit registered alignment or other non-orthogonal orientation of the respective loops 12*a*, 14*a***.

As shown in FIG. 5, the loops **12*a*, 14*a* can thus be placed around a book 20*a* along a coincident axis. This arrangement is particularly advantageous with books having an extensive length dimension as compared to the height dimension and therefore permits the encirclement around the height dimension as shown in FIG. 5**.

Furthermore, the detachability of the loops **12*a*, 14*a* by use of the snap fastener 18*a***, provides additional versatility in that different size loops can be combined as may be required for accommodating a specific book. It should also be apparent that a Velcro, hook and eye connection, can also be utilized for additional flexibility in combining loop members.

It should thus be seen that there is provided a combined book closure and page indexing device which achieves the various objects of this invention and which is well adapted to meet conditions of practical use.

Since various possible embodiments might be made of the present invention or modifications might be made to the exemplary embodiments set forth, it is to be understood that all materials shown and described in the accompanying drawings are to be interpreted as illustrative and not a limiting sense.

With these ends in view, the invention finds embodiment in certain combinations of elements and arrangement of parts by which the aforementioned objects and certain other objects are hereinafter attained, all as more fully described with reference to the accompanying drawings and the scope of which is more particularly pointed out and indicated in the appended claims.

Having thus described the invention there is claimed as new and desired to be secured as Letters Patent:

1. A combined book closure and page indexing device for use with a book having a front cover and a back cover and a plurality of pages interposed therebetween, comprising yieldable page indexing means adapted for snug securement around at least one of said front and back covers along a longitudinal axis with respect to the book and over a selected number of pages, further including book closure means connected to the page indexing means at a common locus, said book closure means being adapted for selectively circumscribing the front and back covers along at least one of a transverse axis with respect to the book and the longitudinal axis for simultaneously securing the book in a closed position.

2. A combined book closure and page indexing device as claimed in claim 1 wherein the longitudinal axis extends along the heighth dimension of the book.

3. A combined book closure and page indexing device as claimed in claim 1 wherein the transverse axis extends along the width dimension of the book.

4. A combined book closure and page indexing device as claimed in claim 1 wherein the page indexing means and the book closure means are adapted for placement around the respective book pages the and front and back cover along a coincident axis with respect to the book.

5. A combined book closure and page indexing device as claimed in claim 1 wherein the page indexing means comprises a continuous loop fabricated of an elastomeric material.

6. A combined book closure and page indexing device as claimed in claim 5 wherein the closure means comprises a continuous loop fabricated of an elastomeric material.

7. A combined book closure and page indexing device as claimed in claim 6 wherein the elastomeric material is comprised of a fabric containing elastic fibers.

8. A combined book closure and page indexing device as claimed in claim 7 wherein said fabric is adapted for accepting a printed indicia thereon.

9. A combined book closure and page indexing device as claimed in claim 1 wherein the page indexing means and the book closure means are each comprised of a continuous loop, said loops being oriented orthogonally with respect to each other when the book is secured in the closed position.

10. A combined book closure and page indexing device as claimed in claim 9 wherein said loops are detachably connected at the common locus.

11. A combined book closure and page indexing device as claimed in claim 10 wherein the connection at the common locus is comprised of a releasable fastener.

12. A combined book closure and page indexing device as claimed in claim 11 wherein the releasable fastener provides for displacement of the respective loops about the common locus.

13. A combined book closure and page indexing device as claimed in claim 12 wherein the respective loops are rotatably displacable about the common locus.

14. A combined book closure and page indexing device as claimed in claim 1 wherein the indexing means lies within a first plane and the closure means lies within a second plane, said second plane being displaced ninety degrees with respect to the first plane.

15. A combined book closure and page indexing device as claimed in claim 14 wherein the page indexing means is comprised of a continuous loop.

16. A combined book closure and page indexing device as claimed in claim 16 wherein the book closure means is comprised of a continuous loop.

17. A combined book closure and page indexing device as claimed in 14 wherein the page indexing means is arranged orthogonally with respect to the book closure means and parallel to the surface of the page when the book is retained in the closed position.

18. A combined book closure and page indexing device as claimed in claim 14 wherein the book closure means is displaceable about the common locus for coincident alignment with the page indexing means when the book is retained in the closed position.

19. A combined book closure and page indexing device as claimed in claim 14 wherein the page indexing means and the book closure means are comprised of an elastomeric containing fabric adapted for displaying advertising indicia.

20. A combination closure and page indexing device for separating a plurality of pages contained between an interconnected front and back cover comprising indexing means including a first yieldable loop member, said loop member being adapted for encircling at least one of the front and back covers and a selected number of pages, said first loop member further extending along a longitudinal axis with respect to the covers, indexing means including a second yieldable loop member, said second loop member being connected to the first loop member at a common locus and being further adapted for circumscribing the front and back covers along at least one of a transverse axis with respect to the covers and the longitudinal axis to simultaneously secure the pages between the covers.

* * * * *